US006131497A

United States Patent [19]

Horde

[11] Patent Number: 6,131,497

[45] Date of Patent: Oct. 17, 2000

[54] GAS CYLINDER WITH TIME DELAY

[75] Inventor: Boice Horde, Westland, Mich.

[73] Assignee: Forward Industries, LLC, Dearborn, Mich.

[21] Appl. No.: 09/287,595

[22] Filed: Apr. 7, 1999

[51] Int. Cl.[7] ..... B21D 24/02

[52] U.S. Cl. ..... 83/639.5; 83/639.1; 72/453.13; 267/119

[58] Field of Search ..... 83/617, 623, 639.1, 83/639.5, 639.2, 128, 124; 72/453.13, 350, 351; 267/119

[56] References Cited

U.S. PATENT DOCUMENTS

| | | | |
|---|---|---|---|
| 2,612,951 | 10/1952 | Palmleaf | 83/639.1 X |
| 3,914,978 | 10/1975 | Sekanina et al. | 72/466.7 |
| 4,342,448 | 8/1982 | Wallis | 267/119 |
| 4,572,489 | 2/1986 | Wallis | 267/119 |
| 4,774,865 | 10/1988 | Wallis | 83/128 |
| 5,100,113 | 3/1992 | Imanishi | 267/119 |
| 5,170,627 | 12/1992 | Wallis | 60/545 |

*Primary Examiner*—M. Rachuba
*Assistant Examiner*—Dominic Troiano
*Attorney, Agent, or Firm*—Reising, Ethington, Barnes, Kisselle, Learman & McCulloch P.C.

[57] ABSTRACT

A die stamping system in which an upper die moves downwardly toward and upward away from a lower die to stamp a workpiece, and in which a portion of the lower die is supported by at least one gas cylinder coupled to gas under pressure to cushion downward movement of the lower die portion and delay upward movement of the lower die portion. Each gas cylinder has a piston reciprocable within a vertical cylinder body. The piston has an upwardly extending piston rod for engaging the lower die portion. The cylinder body has a lower portion beneath the piston connected to the gas under pressure. A first passage connects an upper portion of the cylinder body above the piston to the lower portion of the cylinder body beneath the piston. A second passage connects the lower portion of the cylinder body to a tank. A third passage connects the upper portion of the cylinder body to the tank. First, second and third valves in the respective first, second and third passages control gas flow. When the piston descends, the gas pressure in the lower portion of the cylinder body increases, and by opening the second valve this pressure is transmitted to the tank. By closing the second valve and opening the third valve, the increased gas pressure in the tank is transmitted to the upper portion of the cylinder body to hold the piston down.

12 Claims, 2 Drawing Sheets

GAS CYLINDER WITH TIME DELAY

This invention relates generally to control systems for providing a time delay in a blanking machine system.

BACKGROUND AND SUMMARY OF THE INVENTION

In a typical fine blanking apparatus, it is desirable to accurately cut and punch a slug from a workpiece. Such apparatus usually includes an upper die and a lower die, the lower die having a movable portion supporting the slug to be cut. In order to ensure the desired precision, it has been common practice to provide a delay in the movement of the lower die portion upwardly after the slug has been cut and punched from the workpiece. Such a delay has been produced by cam control or by a hydraulic system. These systems do not "delay" ascent in the sense of holding the slug supporting lower die portion in the down position, but rather slow its rise.

One object of the present invention is to provide a system for retaining the slug-supporting lower die portion in a down position for a predetermined period of time. The invention also has the capability of controlling the rise of the slug-supporting lower die portion and of stopping the rise at an intermediate position.

In accordance with the specific embodiment about to be described, the portion of the lower die supporting the cut slug is supported by at least one gas cylinder coupled to gas under pressure to cushion its downward movement and delay its upward movement. Each of the cylinders comprises a piston reciprocable within a vertical cylinder body. The piston has an upwardly extending piston rod engaging the slug-supporting portion of the lower die. The lower portion of the cylinder body beneath the piston is connected to gas under pressure. A passage connects the upper portion of the cylinder body above the piston to the lower portion of the cylinder body beneath the piston. A passage connects the lower portion of the cylinder body to a tank, and a passage connects the upper portion of the cylinder body to the tank. Valves are provided to control gas flow in the respective passages.

Further in accordance with the invention, a controller is provided for opening and closing the valves in a predetermined sequence. At the beginning of a cycle, the valve in the passage between the lower portion of the cylinder body and the tank may be open while the valve in the passage between upper portion of the cylinder body and the tank is closed, and the valve in the passage connecting the upper and lower portions of the cylinder body are closed. When the piston moves downwardly, the increased gas pressure in the lower portion of the cylinder body increases the pressure in the tank, after which the valve in the passage between the lower portion of the cylinder body and the tank is closed and the valve in the passage connecting the upper and lower portions of the cylinder body is opened to equalize the pressure therein. Then the valve in the passage connecting the upper and lower portions of the cylinder body is closed and the valve in the passage connecting the tank to the upper portion of the cylinder body is opened to transmit the increased gas pressure from the tank to the upper portion of the cylinder body and thereby hold the piston in the down position.

The controller is also capable of controlling the rise of the piston in the cylinder body and of stopping the rise at an intermediate position.

A further object of the invention is to provide a system for obtaining a predetermined time delay in a blanking machine having the foregoing features and capabilities.

These and other objects, features and advantages of the invention will become more apparent as the following description proceeds, especially when considered with the accompanying drawings.

DETAILED DESCRIPTION OF THE PREFERRED EMBODIMENT

Figure 2:
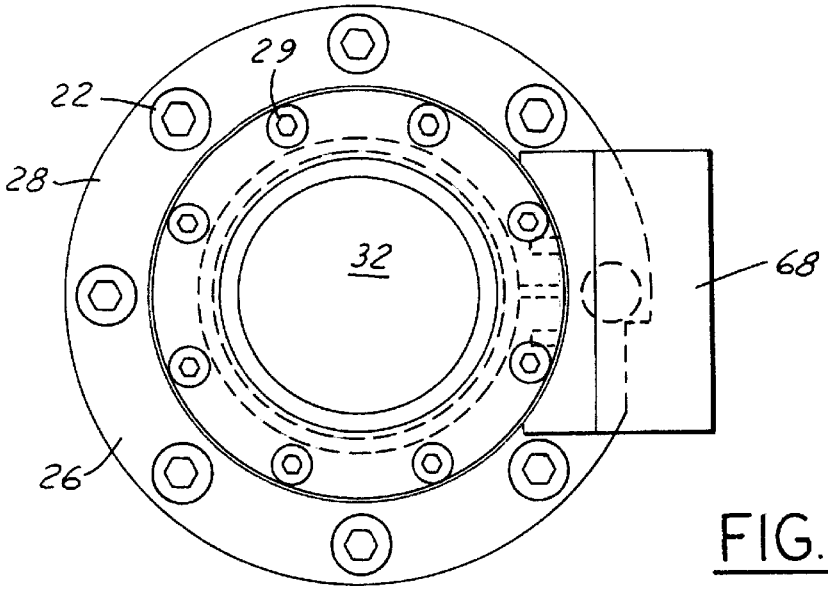
FIG. 2 is a top plan view of the system of FIG. 1.

Referring now more particularly to the drawings, the die stamping system of this invention for fine blanking is intended to be used with a die stamping press 10. As shown diagrammatically in FIG. 3, the press 10 includes an upper die 11 which has a punch 12 movable downwardly toward and upwardly away from a lower die 13 to punch a slug from a workpiece W. The lower die 13 includes a portion 14 which supports the slug and which is movable downwardly within the lower die. A plurality of cylinder assemblies 16, 18 and 20 (FIG. 4) are provided to support this movable portion 14 of the lower die. More specifically, the lower portion 14 of the die is supported by a pressure plate 15 which in turn is supported by the cylinder assemblies 16–20. The cylinder assemblies are mounted on a manifold 21 by bolts 22 and are supplied with an inert gas such as nitrogen under a predetermined high pressure. The pressure of the inert gas may vary between about 500 psi and 2000 psi.

In accordance with the invention, the cylinder assemblies 18–20 are provided with a time delay such that upward movement of the lower die portion 14 is delayed when the die is opened. This ensures that the ejection of the slug will not interfere with the accuracy of the hole that has been cut in the workpiece.

Figure 1:
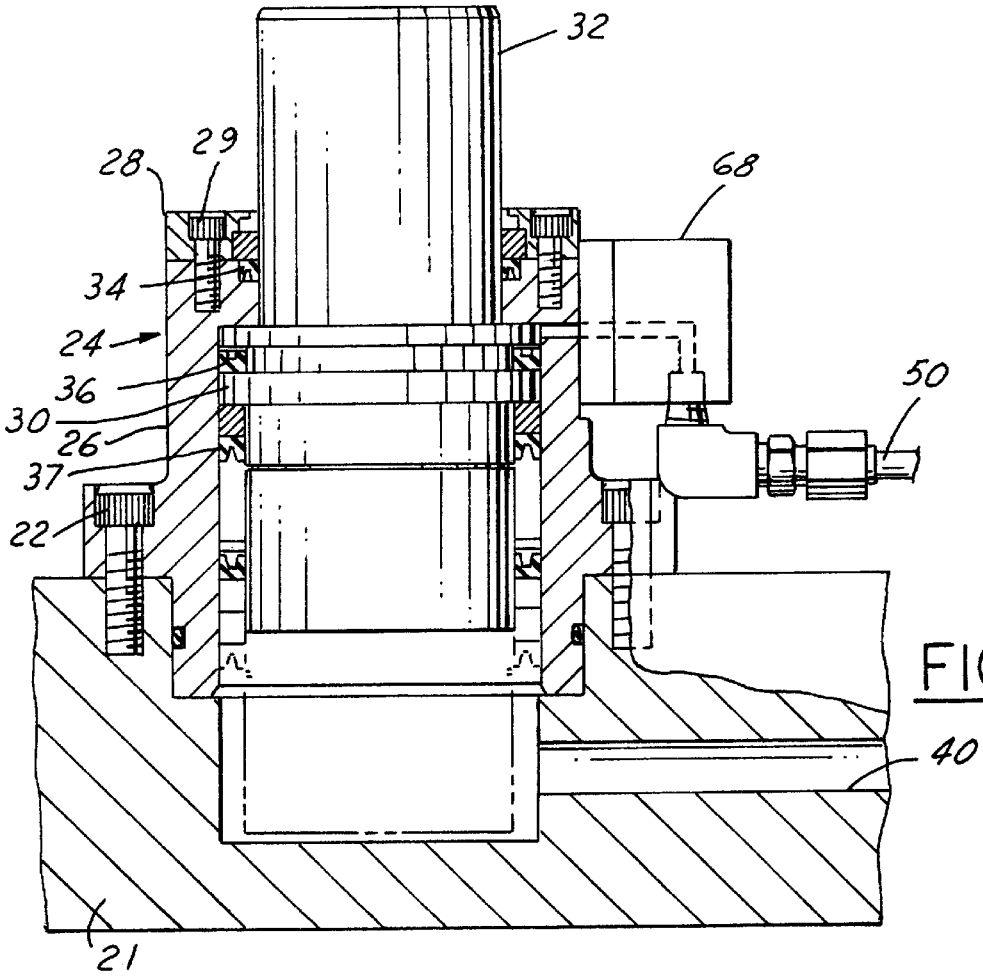
FIG. 1 is a vertical sectional view of a cylinder system for a die blanking machine, showing a gas cylinder for cushioning the downward movement of a portion of a lower die of the blanking machine. A portion of the blanking machine is shown diagrammatically in FIG. 3.

Each cylinder assembly includes a vertical cylinder body 24 having a cylindrical side wall 26 closed at the top by a plate 28 secured to the side wall by bolts 29. Vertically reciprocable within each cylinder body 24 is a piston 30 which has a piston rod 32 extending vertically upwardly through a central opening in the top plate 28 to support the pressure plate 15 which in turn supports the lower portion 14 of the die. The piston rod 32 is concentric with but of smaller diameter than the piston. An annular seal 34 at the upper end of the cylinder body seals against the piston rod 32. The piston 30 carries annular seals 36 and 37 for sealing against the inner surface of the side wall 26 of the cylinder body. FIG. 1 shows the piston in its vertically upwardly extended position in solid lines and in a down position in broken lines.

Figure 3:
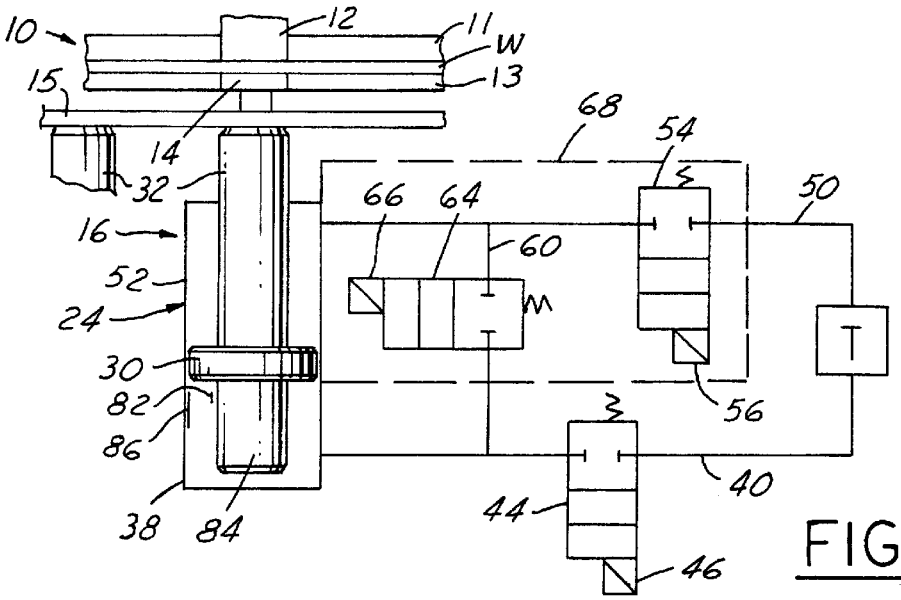
FIG. 3 is a diagrammatic view showing the system for controlling the operation of one of the gas cylinders.

FIG. 3 shows diagrammatically the system for operating the piston 30 to control its vertical movement and its vertical position in the cylinder body 24. As there shown, a tank T is connected to the lower portion 38 of the cylinder body beneath the piston by a fluid passage 40. A valve 44 is provided in the fluid passage 40. The valve 44 is shown in its normal closed position but may be shifted to open position by energization of its solenoid 46.

A fluid passage 50 connects the upper portion 52 of the cylinder body above the piston to the tank T. A valve 54 controls the passage 50 and is shown in its normally closed position. The valve 54 may be shifted to open position by energization of its solenoid 56.

A fluid passage 60 communicates at its ends with the passages 40 and 50 at points located between the cylinder body and the valves 44 and 54 to provide communication between the lower and upper portions 38 and 52 of the cylinder body. The passage 60 is controlled by a valve 64 which is shown in its normally closed position. The valve 64 may be shifted to open position by energization of its solenoid 66.

The valves 54 and 64 are housed in a single valve structure 68 mounted on the outer surface of an upper portion of the side wall 26 of the cylinder body 24.

Figure 4:
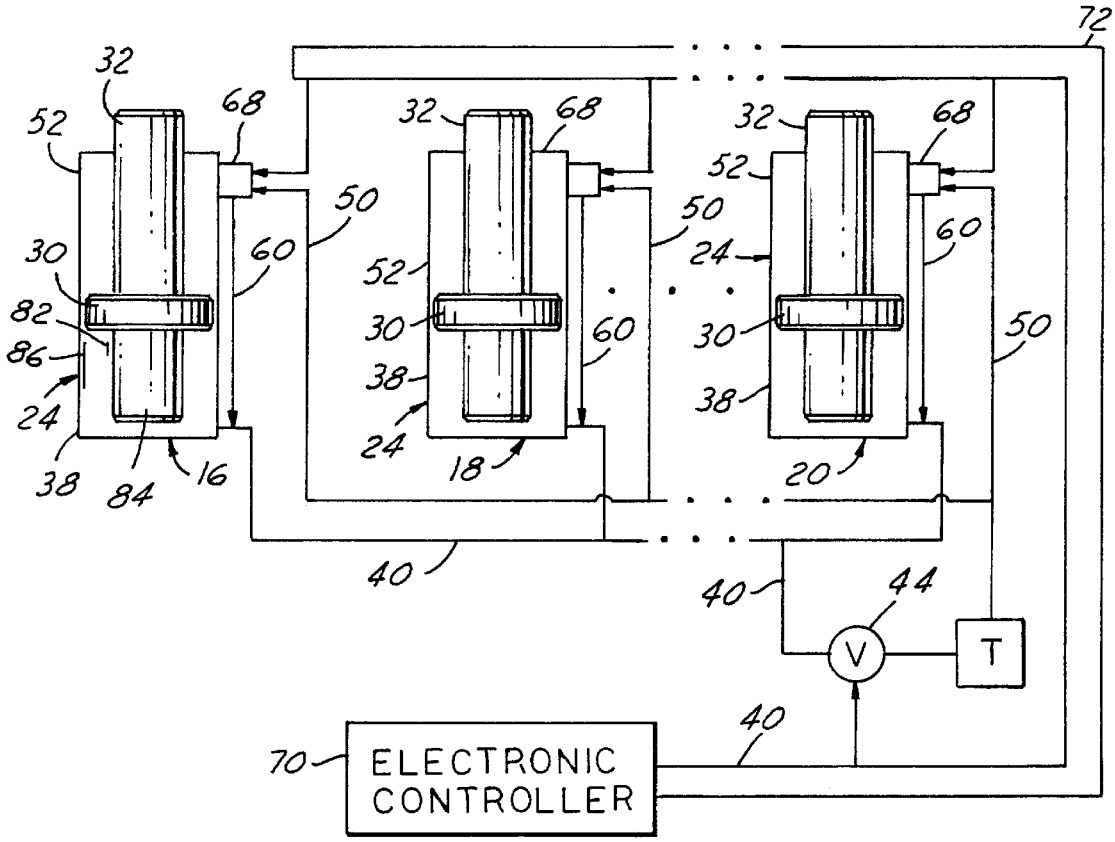
FIG. 4 is a diagrammatic view showing the system as applied to a plurality of gas cylinders.

FIG. 4 shows diagrammatically a plurality of cylinder assemblies 16, 18 and 20 for supporting the portion 14 of the lower die.

The passages 40, 50 and 60 to the cylinder assembly 16 shown in FIG. 3 have parallel connections to the cylinder assemblies 18 and 20 in FIG. 4. The cylinder assemblies 18 and 20 have the same valve structures 68 provided with the same valves 54 and 64. The solenoid operated valve 44 is also provided in FIG. 4. Accordingly, the cylinder assemblies 16, 18 and 20 act in concert with one another.

An electronic controller 70 is provided to control the operation of the valves 44, 54 and 64 through a bus 72. The electronic controller 70 may be set such that at the beginning of a cycle when the pistons 30 are in their uppermost positions, the valves 54 and 64 are closed but the valve 44 is open, placing the lower portion 38 of the cylinder bodies 24 in communication with the tank T. The lower portions 38 of the cylinder bodies are, of course, in. constant communication with manifold pressure. When the pistons 30 are moved downwardly during a punching operation, the pressure in the lower portion of the cylinder bodies 24 cushions the descent of the pistons and this pressure increases. This increase in pressure is transmitted to the tank T. When the pistons 30 reach their lowermost or down positions, the controller de-energizes solenoid 46 to close valve 44 to isolate the tank T from the lower portion of the cylinder bodies. The controller then energizes solenoids 66 to open the valves 64 to place the upper and lower portions of the cylinder bodies in communication with one another, thus equalizing the pressure therein. Thereafter the controller 70 de-energizes the solenoids 66 to close valves 64 and energizes the solenoids 56 to open the valves 54 and connect the tank T to the upper portions of the cylinder bodies. The pistons 30 are thereby held in the down position. The delay in the subsequent rise of the pistons, that is, the period of time they are held down, depends on the setting of the controller.

The controller 70 may also be set to cause the pistons to be held in a selected intermediate position by proper timing of the operation of the valves 44, 54 and 64.

To return the pistons 30 to the up, or starting position, and thereby raise the portion 14 of the lower die supporting the slug, the solenoids of all three valves 44, 54 and 64 are energized. This opens all valves and supplies equal pressure in both the upper and lower portions 38 and 52 of the cylinder bodies 24. Because of the presence of the piston rod 32, the effective area of the top of the piston is less than that at the bottom of the piston, and, therefore, the pistons rise to their up or starting positions. When the pistons arrive at their uppermost positions, the controller will reset the valves to the positions they had at the beginning of the cycle.

In the operation of the electronic controller, it is desirable to know the position of the pistons 30 in their cylinders. For this purpose, and as shown diagrammatically in FIGS. 3 and 4, a position encoder including a magnetic strip 82 connected to the lower extension 84 of one of the pistons 30, and a reader, such as a Hall sensor 86, carried by the side wall 26 of the cylinder body, may be provided to read the position of the piston. Piston position information is transmitted to the controller 70 by the encoder.

Although the tank T has been illustrated as a separate element in FIGS. 3 and 4, it is also contemplated that the tank may be part of the manifold 21 (FIG. 1).

What is claimed is:

1. In a die stamping system in which an upper die moves downwardly toward and upward away from a lower die to stamp a workpiece, and in which a portion of the lower die is supported by at least one gas cylinder coupled to gas under pressure to cushion downward movement of the lower die portion and delay upward movement of the lower die portion, the improvement wherein said at least one gas cylinder comprises:

a piston reciprocable within a vertical cylinder body, the piston having an upwardly extending piston rod for engaging the lower die portion and the cylinder body having a lower portion beneath the piston connected to the gas under pressure, first passage means connecting an upper portion of the cylinder body above the piston to the lower portion of the cylinder body beneath the piston, a tank for containing gas cylinder system operating gas to provide a reservoir supply of the gas under pressure, second passage means comprising said lower portion of the cylinder body below the piston to said tank, third passage means connecting the upper portion of the cylinder body above the piston to said tank such that said tank provides an operating source of the gas under pressure and is operably coupled by said second and third passage means in series gas flow relationship between and to said upper and lower portions of the cylinder body, and first, second and third valve means for controlling gas flow in said respective first, second and third passage means.

2. The system set forth in claim 1, wherein said first and second valve means are incorporated into a single valve structure mounted on the cylinder body.

3. The system set forth in claim 1, and further including means for selectively opening and closing said first, second and third valve means.

4. The system set forth in claim 1, and further including means for opening said second valve means to transmit increased gas pressure to said tank when said piston moves downwardly and thereafter to close said second valve means and open said third valve means to transmit the increased gas pressure in the tank to the upper portion of said cylinder body.

5. The system set forth in claim 1, wherein said first, second and third valve means are operated by a controller.

6. The system set forth in claim 1, and further including means operated by an electronic controller for opening said second valve means to transmit increased gas pressure to the tank when said piston moves downwardly, thereafter to close said second valve means to isolate the tank from the lower portion of the cylinder body and open said first valve means to equalize the pressure between the upper and lower portions of the cylinder body, and then to close said first valve means and open said third valve means to transmit the increased gas pressure in the tank to the upper portion of the cylinder body to hold the piston in a down position.

7. The system set forth in claim 6, wherein said means operated by said controller is operative, after the piston is held in a down position for a predetermined period of time, to open all of said valve means to equalize the pressure between the upper and lower portions of the cylinder body, said piston rod reducing the effective area of the top of the piston compared to the area of the bottom of the piston so that the piston will rise.

8. The system set forth in claim 7, wherein said first and second valve means are incorporated into a single valve structure mounted on the cylinder body.

9. In a die stamping system in which an upper die moves downwardly toward and upward away from a lower die to stamp a workpiece, and in which a portion of the lower die is supported by at least one gas cylinder coupled to gas under pressure to cushion downward movement of the lower die portion and delay upward movement of the lower die portion, the improvement wherein said at least one gas cylinder comprises:

a piston reciprocable within a vertical cylinder body, the piston having an upwardly extending piston rod for engaging the lower die portion and the cylinder body having a lower portion beneath the piston connected to the gas under pressure, first passage means connecting an upper portion of the cylinder body above the piston to the lower portion of the cylinder body beneath the piston, a tank, second passage means connecting said lower portion of the cylinder body to said tank, third passage means connecting the upper portion of the cylinder body to said tank, first, second and third valve means for controlling gas flow in said respective first, second and third passage means, and means for opening said second valve means to transmit increased gas pressure to said tank when said piston moves downwardly and thereafter to close said second valve means and open said third valve means to transmit the increased gas pressure in the tank to the upper portion of said cylinder body.

10. In a die stamping system in which an upper die moves downwardly toward and upward away from a lower die to stamp a workpiece, and in which a portion of the lower die is supported by at least one gas cylinder coupled to gas under pressure to cushion downward movement of the lower die portion and delay upward movement of the lower die portion, the improvement wherein said at least one gas cylinder comprises:

a piston reciprocable within a vertical cylinder body, the piston having an upwardly extending piston rod for engaging the lower die portion and the cylinder body having a lower portion beneath the piston connected to the gas under pressure, first passage means connecting an upper portion of the cylinder body above the piston to the lower portion of the cylinder body beneath the piston, a tank, second passage means connecting said lower portion of the cylinder body to said tank, third passage means connecting the upper portion of the cylinder body to said tank, first, second and third valve means for controlling gas flow in said respective first, second and third passage means, means operated by an electronic controller for opening said second valve means to transmit increased gas pressure to the tank when said piston moves downwardly, thereafter to close said second valve means to isolate the tank from the lower portion of the cylinder body and open said first valve means to equalize the pressure between the upper and lower portions of the cylinder body, and then to close said first valve means and open said third valve means to transmit the increased gas pressure in the tank to the upper portion of the cylinder body to hold the piston in a down position.

11. The system set forth in claim 10, wherein said means operated by said controller is operative, after the piston is held in a down position for a predetermined period of time, to open all of said valve means to equalize the pressure between the upper and lower portions of the cylinder body, said piston rod reducing the effective area of the top of the piston compared to the area of the bottom of the piston so that the piston will rise.

12. The system set forth in claim 11, wherein said first and second valve means are incorporated into a single valve structure mounted on the cylinder body.

* * * * *